US006358610B1

(12) United States Patent
Taniguchi et al.

(10) Patent No.: US 6,358,610 B1
(45) Date of Patent: Mar. 19, 2002

(54) HOSE REINFORCING FILAMENT CORD

(75) Inventors: Masaharu Taniguchi; Tomoharu Kumaki; Yasumi Kanda, all of Aichi (JP)

(73) Assignee: Toray Industries, Inc. (JP)

( * ) Notice: Subject to any disclaimer, the term of this patent is extended or adjusted under 35 U.S.C. 154(b) by 0 days.

(21) Appl. No.: 09/291,489

(22) Filed: Apr. 14, 1999

(30) Foreign Application Priority Data

Apr. 16, 1998 (JP) ..... 10-106001

(51) Int. Cl.[7] ..... D02G 3/36

(52) U.S. Cl. ..... 428/375; 428/357; 428/394; 428/395; 428/396

(58) Field of Search ..... 428/357, 375, 428/394, 395, 396

(56) References Cited

FOREIGN PATENT DOCUMENTS

JP 10273877 * 3/1997

* cited by examiner

*Primary Examiner*—Elizabeth M. Cole
(74) *Attorney, Agent, or Firm*—Schnader Harrison Segal & Lewis LLP

(57) ABSTRACT

Rubber reinforcing polyester filament cord having flexibility, adhesiveness to halogenated butyl rubber and EPDM rubber, and smoothness; comprising a polyester filament yarn with a surface coating of an aromatic polyepoxide, initial condensation product of resorcin-formaldehyde (A) and a rubber latex (B), single-twisted at 3–150 turns per meter to make a twisted cord and satisfying properties (a) to (c):

(a) about 0.15 to 0.35 coefficient of dynamic friction between filament cord and smooth metal, (b) about 0.05 or less variation of coefficient of dynamic friction between filament cord and smooth metal, and (c) about 3 wt % or more rubber remaining after standard cord stripping test.

3 Claims, 2 Drawing Sheets

HOSE REINFORCING FILAMENT CORD

TECHNICAL FIELD

This invention relates to a hose reinforcing filament cord, a production method thereof, and the hose produced by the method.

In more detail, the invention relates to a hose reinforcing multiple filament cord and to a substantially trouble-free hose production process. It further relates to a reinforcing cord that has both excellent flexibility and adhesiveness to rubber compounds in the hose, such as halogenated butyl rubber or ethylene-α-olefin-nonconjugated diene copolymer rubber compositions (hereinafter called "EPDM rubber"). The invention further relates to the hose produced.

BACKGROUND ART

Polyester filament yarns such as polyethylene terephthalate filament yarns have useful physical properties for reinforcing hoses. They have high tenacity and modulus, small elongation and creep and excellent fatigue resistance. They have been used for incorporation into rubber hose reinforcing filament cords.

However, polyester filament yarns suffer from the problem of having poor adhesiveness to rubber, since they are inactive on rubber surfaces.

For example, hoses used for automobile air conditioners in recent years generally consist of an innermost layer made of a polyamide resin in contact with a refrigerant gas, a layer formed of gas-impermeable halogenated butyl rubber such as chlorinated butyl rubber around the innermost layer, a further reinforcing layer formed of reinforcing filament cords of polyester filament yarns having an adhesive composition film disposed around its surface and in contact with the halogenated butyl rubber layer, and another layer formed of a halogenated butyl rubber or EPDM rubber around the cord layer. Various techniques have been developed to improve the adhesiveness between the polyester filament cords and the halogenated butyl rubber or EPDM rubber layers in this hose, without success.

To complicate the matter, when plural adhesive-treated filament cords are mechanically paralleled and braided, or paralleled and spiraled, as is often desirable in hose construction, the filament cords cannot be accurately paralleled due to frictional resistance that exists between the adhesive-treated filament cords, or due to friction with associated guides, to deform the hose, or to cause deposition waste material from various treating agents to adhere or be scattered in the vicinity, thus lowering productivity and polluting the working environment. Furthermore, when the filament cords are used for hose for reinforcing brakes, or for hose for carrying a refrigerant gas, the filament cords are required to have good flexibility and resistance, and to attain good hose installation convenience, vibration absorbability, and other beneficial properties not heretofore attainable.

Japanese Patent Laid-Open (Kokai) No. 62-276083 describes a method for treating a rubber reinforcing polyester filament yarn, by treating a polyester filament yarn with a treating agent containing a cresol novolak type polyepoxide and water soluble nylon, successively treating with a treating agent containing a polyepoxide compound, blocked isocyanate and rubber latex, and then treating with a mixture consisting of resorcin, formaldehyde, rubber latex, ethyleneurea and cresol novolak type polyepoxide. However, when such filament cords are applied to a hose, their adhesiveness to EPDM rubber or halogenated butyl rubber is inadequate.

Japanese Patent Laid-Open (Kokai) No. 63-92776 describes treating a polyester filament yarn by a first treating agent containing an epoxy compound and treating by a second treating agent containing a mixture consisting of an initial condensation product of resorcin-formaldehyde and rubber latex, ethyleneurea compound, cresol novolak type polyepoxide and inorganic oxide. However, the resulting polyester filament yarn has problems. Its adhesiveness to halogenated butyl rubber is poor. Further, a large amount of dust is caused by the treating agents and is scattered during the hose production process, with detriment to the working environment.

Japanese Patent Laid-Open (Kokai) No. 10-81862 discloses a method for treating a polyester filament yarn using a treating agent obtained by mixing an initial condensation product of resorcin-formaldehyde, styrene-butadiene-vinylpyridine terpolymer latex, styrene-butadiene copolymer latex and cresol novolak type polyepoxide at a specific ratio.

Japanese Patent Laid-Open (Kokai) No. 61-19878 describes a filament cord treated by a mixture consisting of an initial condensation product of resorcin-formaldehyde, styrene-butadiene-vinylpyridine terpolymer latex, styrene-butadiene copolymer latex, parachlorophenol-resorcin-formaldehyde co-condensation product and dimethylsiloxane, to make the rubber reinforcing filament cord smooth.

However, it is difficult to secure the necessary adhesiveness even by these methods, and it is actually impossible to satisfy all of the combined properties of adhesiveness, flexibility, friction resistance in the hose production process, and still resolve the problem of deposition of waste from treating agents.

OBJECTS OF THE INVENTION

An object of the invention is to provide a rubber hose reinforcing polyester filament cord having excellent flexibility and adhesiveness to a halogenated butyl rubber compound or EPDM rubber compound, without causing difficulties such as deposit of waste from treating agents in the hose production process.

It is another object to provide a trouble-free production method for such a hose.

More specifically, another object of the invention is to provide a method for producing a rubber hose reinforcing polyester filament cord, which satisfies all of the requirements for flexibility of the filament cord, adhesiveness of the cord to a halogenated butyl rubber or to an EPDM rubber, and to provide smoothness of the filament cord, all without deposit of excessive waste from treating agents in the processing area.

The foregoing and other objects and advantages of this invention will further become apparent, and in the drawings.

BRIEF DESCRIPTION OF THE INVENTION

The hose reinforcing filament cord of the present invention, which achieves all of the above objectives in combination, has mainly the following constitution.

Figure 1:
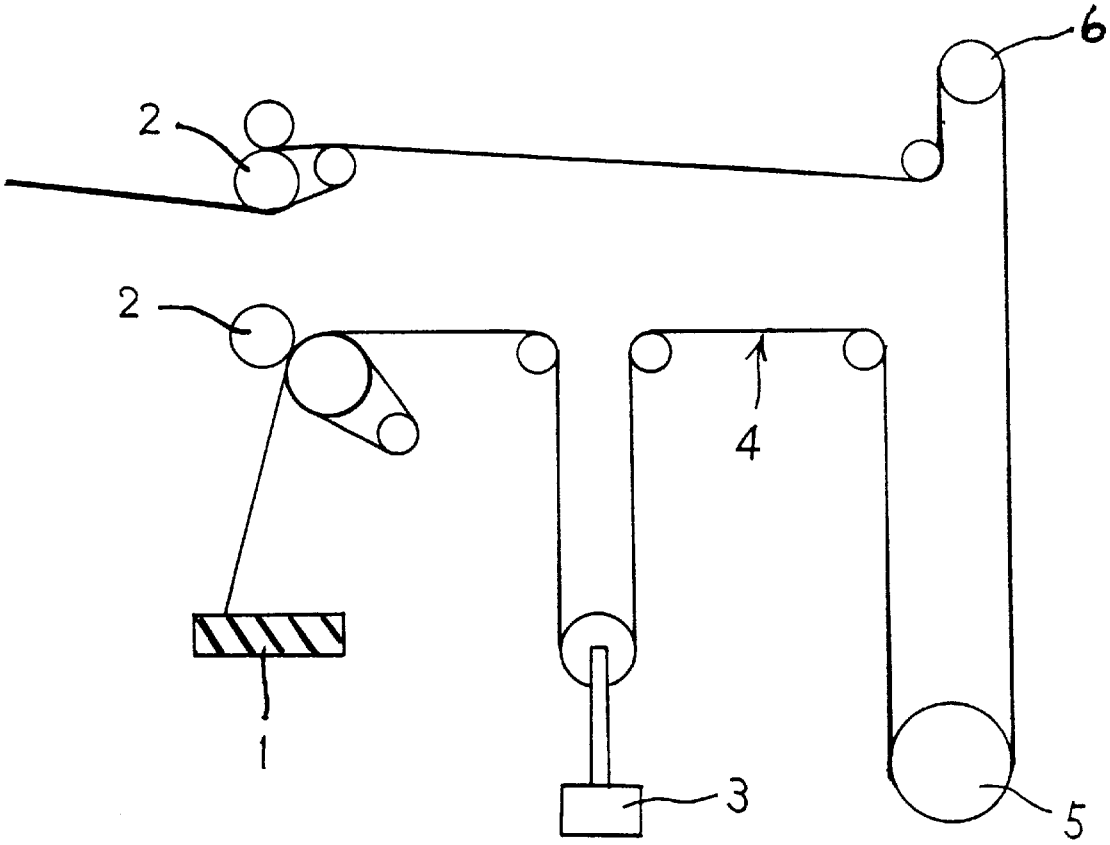
FIG. 1 is a view in side elevation showing how to measure the coefficient of dynamic friction between the filament cord of this invention and a metal.

The hose reinforcing filament cord is single-twisted at about 3–150 turns per meter. It comprises a polyester filament cord, the surface of which carries an initial aromatic polyepoxide and a deposited condensation product of resorcin-formaldehyde (A), and a rubber latex (B). It has all of the following properties (a) to (c):

(a) a coefficient of dynamic friction of about 0.15 to 0.35 between the filament cord and a standard smooth metal surface, measured as indicated in FIG. 1 of the drawings and further described in detail hereinafter, (b) a variation of coefficient of dynamic friction between the filament cord and the smooth metal of about 0.05 or less, and (c) a residual rubber covering of about 3 wt % or more, after having been subjected to a standard cord stripping test to be described in detail hereinafter.

The method for producing such a fiber cord comprises the steps of treating the surface of a polyester filament cord, single-twisted at about 3–150 turns per meter, with: (a) a treating agent containing an aromatic polyepoxide water dispersion, and subsequently treating the cord with a treating agent (b) containing a mixture of at least an initial condensation product of resorcin-formaldehyde (A) and a rubber latex (B), to form an adhesive film on the surface of the polyester multi-filament yarn.

The hose according to the invention is reinforced by hose reinforcing filament cords obtained by the method defined above, adhered to one or more surfaces comprising a halogenated butyl rubber and/or an EPDM rubber, at least as the rubber which lies in contact with the filament cords to make up the hose.

The filament cord of the present invention, and the production method thereof, create a twisted polyester filament cord that has high quality properties, including good processing behavior in the hose production process, and excellent flexibility and strong adhesiveness to halogenated butyl rubber and to EPDM rubber.

PREFERRED EMBODIMENTS OF THE INVENTION

The polyester filament yarn used in the hose reinforcing filament cord of the present invention is a filament yarn of a polyester comprising dicarboxylic acids and glycols, with ethylene terephthalate as a main component.

The dicarboxylic acids which can be used in the polyester include terephthalic acid, 2,6-naphthalenedicarboxylic acid, isophthalic acid, 1,4-cyclohexanedicarboxylic acid, or many others, as will be understood. The glycols which can be used include ethylene glycol, propylene glycol, tetramethylene glycol, 1,4-cyclohexanedimethanol, and many others. The dicarboxylic acids can be partially substituted for by adipic acid, sebacic acid, dimer acid, metal sulfonate substituted isophthalic acid, etc., and the glycols can be partially substituted for by diethylene glycol, neopentyl glycol, 1,4-cyclohexanediol, 1,4-cyclohexanedimethanol, polyalkylene glycol, etc.

Among the polyesters, polyethylene terephthalate consisting of terephthalic acid accounting for about 90 mol % or more of the dicarboxylic acids and ethylene glycol accounting for about 90 mol % or more of the glycols are suitable.

The polyester can also contain various particles such as various inorganic particles of titanium oxide, silicon oxide, calcium carbonate, silicon nitride, clay, talc, kaolin or zirconic acid, crosslinked high molecular weight particles or various metal particles, and/or any other conventional additive such as antioxidant, sequestering agent, ion exchanging agent, coloring preventive, wax, silicone oil and various surfactants. If the filament cord is used for reinforcing the hose used in an automotive air conditioner, it is preferable to use a polyethylene terephthalate that does not contain any other third component added or copolymerized, other than byproduced diethylene glycol, and substantially not containing any such additives as inorganic particles. This is preferable because it can achieve higher dimensional stability and tenacity.

An important feature of the present invention is accordingly a polyester filament yarn single-twisted at about 3–150 turns per meter, having on its surface an aromatic polyepoxide and a condensation product of resorcin-formaldehyde (A) and a rubber latex (B), and satisfying all of the following properties (a) to (c):

(a) a coefficient of dynamic friction between the filament cord and a smooth metal surface of about 0.15 to 0.35, (b) a variation of coefficient of dynamic friction between the filament cord and a smooth metal surface of about 0.05 or less and (c) a residual rubber covering amount, based on the cord stripping test to be described in detail hereinafter, of about 3 wt % or more.

The polyester filament yarn used in the filament cord of the present invention comprises mainly dicarboxylic acids and glycols, with ethylene terephthalate as a main component. Preferably, polyethylene terephthalate consisting of terephthalic acid accounting for about 90 mol % or more of the dicarboxylic acids and ethylene glycol accounting for about 90 mol % or more of the glycols is suitable. It is preferable that the polyethylene terephthalate does not have any other third ingredient added or copolymerized, other than byproduced diethylene glycol, and is substantially free of any such additives as inorganic particles or the like.

It is also preferable that the polyester filament yarn has an intrinsic viscosity of about 0.80 or more, and contains end-positioned carboxyl groups in an amount of about 20 equivalents/ton or less, especially about 18 equivalents/ton or less. The end carboxyl group concentration may be conveniently measured by the method stated in "Analytical Chemistry", Vol. 26, p. 1614 by Pohl, i.e., by weighing a certain amount of the polyester filament cord, dissolving it into a certain amount of orthocresol at 100° C., cooling to 25° C., and measuring the intended concentration by the potentiometric titration method using a sodium hydroxide methanol solution. If the amount of the end carboxyl groups of the polyester filament yarn is about 20 equivalents/ton or less, the hydrolysis resistance of the hose reinforcing filament cord is good.

When a polyester filament cord is conventionally treated by treating agents to obtain adhesiveness to rubber, a problem arises. When the cord is braided or spiraled, the capability to arrange the filament cords in parallel is lowered because of the frictional resistance between the adhesive-treated filament cords, and because of friction with any adjacent guides. This tends to deform the hose or to cause deposit waste from treating agents to adhere or be scattered in the area, to lower productivity and deteriorate the working environment of the method. However, this problem of the prior art is overcome in accordance with this invention while working within critical parameters of friction properties and variations of frictional forces in specific ranges.

The filament cord of the present invention comprises a polyester multiple filament yarn comprising a condensation product of resorcin-formaldehyde (A) and a rubber latex (B) necessary for achieving adhesiveness to a halogenated butyl rubber and/or an EPDM rubber deposited on it. Its coefficient of dynamic friction is about 0.35 or less, preferably about 0.30 or less, measured between the filament cord and a smooth-surfaced metal.

The coefficient of dynamic friction between a filament cord and a metal, in accordance with the present invention, is determined from the measured frictional force between the filament cord, running at a constant speed, and a metallic pipe. It can be measured using apparatus of the type shown in FIG. 1 of the drawings. Concretely, one filament cord is fed into a running cord-metallic pipe friction tester of the type shown in FIG. 1. It measures the tension $T_1$ on the inlet portion of the testing machine and the tension $T_2$ on the outlet portion of the testing machine with the filament cord kept running at a constant speed, and the coefficient of dynamic friction is calculated from a formula to be discussed in detail hereinafter. Referring to the tension $T_2$ on the outlet side, the upper limit tension $T_{2U}$ is read with the filament cord kept running for at least 3 minutes or more, as will be discussed in further detail hereinafter. The following formula is used:

$$\text{Coefficient of dynamic friction}=(T_{2U}-T_1)/(T_1+T_{2U}).$$

The measurement is effected under the following conditions. The metallic friction part is a satin finished chromium plated pipe having a diameter of 40 mm and a surface roughness of 0.1S.

The temperature of the friction part is 25° C.

The temperature and humidity of the test room are 25° C., 65%.

The contact angle is 180°.

The tension on the friction part inlet side $T_1$ is 1000 g.

The yarn speed is 20 m/min.

If the coefficient of dynamic friction between the filament cord and the smooth metal exceeds about 0.35, the friction between the filament cord and guides, etc. of a braiding machine becomes large and causes treating agents to be dislodged as waste deposit. The generated frictional heat thermally deteriorates the deposit waste, making it lumpy. As a result, various problems are caused such as braiding of the deposit waste in the hose, and defective braiding because of excessive stickiness.

On the contrary, if the coefficient of dynamic friction is smaller than about 0.15, and the filament cord is wound around a bobbin, etc. it tends to undergo pattern deformation. This seriously inconveniences handling.

Furthermore, variation of coefficient of dynamic friction between the filament cord of the present invention and the test metal is about 0.05 or less, preferably about 0.03 or less.

Variation of coefficient of dynamic friction between filament cord and metal is caused when the coefficient of dynamic friction is measured by the friction tester shown in FIG. 1. Concretely, a single filament cord is introduced into the friction tester shown in FIG. 1. The test is run and the variation of dynamic friction is calculated from the tension $T_1$ at the inlet side of the test path, and the tension $T_2$ at the outlet side, with the filament cord kept running at least for 3 minutes or more.

Figure 2:
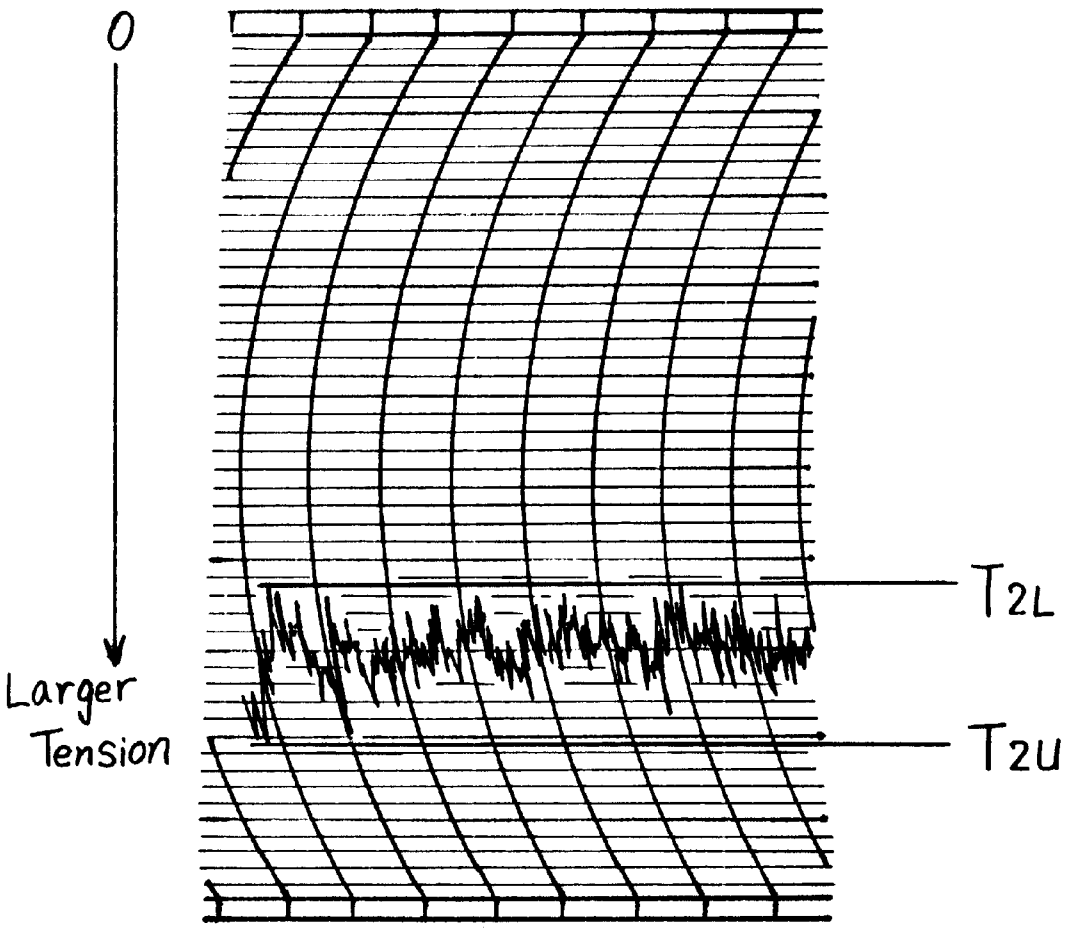
FIG. 2 is a chart showing a diagram of an example of tension variation on a treated pipe outlet surface, as obtained when the coefficient of dynamic friction between the filament cord of the present invention and a smooth metal is measured.

From the diagram of FIG. 2, which shows one example of a tension variation on the treated pipe outlet side, obtained by measuring the coefficient of dynamic friction between the filament cord and the smooth metal, the upper limit $T_{2U}$ and the lower limit $T_{2L}$ of the tensions on the treated pipe outlet side are read. In succession, the coefficients of dynamic friction of the upper limit $T_{2U}$ and the lower limit $T_{2L}$ of the tensions on the treated pipe outlet side are calculated from the equations:

$$\text{Upper limit coefficient of dynamic friction } C_L\text{: } C_U=(T_{2U}-T_1)/(T_1+T_{2U})$$

$$\text{Lower limit coefficient of dynamic friction } C_L\text{: } C_L=(T_{2L}-T_1)/(T_1+T_{2L})$$

The value obtained by subtracting the lower limit coefficient of dynamic friction $C_L$ from the upper limit coefficient of dynamic friction $C_U$ is the variation of the coefficient of dynamic friction of the cord.

If profuse amounts of treating agents separate from the cord, or if deposit waste from treating agents is sticky when the filament cord is run in the friction tester, the variation of coefficient of dynamic friction of the cord becomes high.

Furthermore, it is preferable that the bending stiffness of the filament cord, measured according to the known Gurley stiffness test method, is preferably about 1000 mg or less. If the bending stiffness of the filament cord is 1000 mg or less, the hose is unlikely to be deformed unevenly, even when plural filament cords are paralleled and knitted and braided.

The amount of rubber remaining, after conducting the aforementioned cord stripping test, should be about 3 wt % or more. If the remaining rubber covering amount is about 3 wt % or less, the rubber tends to separate from the filament cord during use as a hose. This is detrimental to the durability of the hose.

It is also preferable that the bending stiffness of the filament cord measured by the Gurley stiffness test method after the filament cord has been heat-treated in dry heat is about 2000 mg or less. If the bending stiffness of the filament cord is about 2000 mg or less after heating, the flexibility is kept still after the hose is formed, and the hose has excellent vibration and noise absorption and fatigue resistance.

The term "bending stiffness" of the filament cord after heating in the present invention refers to the bending stiffness of the filament cord measured according to the standard Gurley stiffness test method after having been heated at 150° C. in dry heat for 2 hours, with a load of 0.1 g/denier applied to the filament cord.

The filament cord of the present invention can be produced, for example, by treating a polyester filament yam, single-twisted at about 3–150 turns per meter, by treating with an agent containing cresol novolak type polyepoxide water dispersion, and treating with another treating agent containing an initial condensation product of resorcin-formaldehyde (A), a rubber latex (B), a parachlorophenol-resorcin-formaldehyde co-condensation product and a polysiloxane compound having a molecular weight of about 1000 to 2000 (D), to form an adhesive composition film on the surface of the filament yam.

In the alternative, the polyester surface may be twisted about 3–150 times per meter by treating with an agent containing an aromatic polyepoxide water dispersion, and treating it with a mixture consisting essentially of at least an initial condensation product of resorcin-formaldehyde (A) and a rubber latex (B), to form an adhesive composition film on the surface of the filament yarn.

In the method of the present invention, a two-bath treatment for applying two treating agents to the filament yarn is necessary, and it is essentially necessary to treat the surface of the polyester filament yarn single-twisted at about 3–150 turns per meter by a first treating agent containing an aromatic polyepoxide water dispersion.

The aromatic polyepoxide in the present invention is a compound having at least one aromatic ring and at least two or more epoxy groups in the molecule. Specifically, it can be a polyepoxide of the phenol novolak type, cresol novolak type, hydroquinone type, biphenyl type, bisphenol S type, brominated novolak type, xylene modified novolak type, phenolglyoxal type, trisoxyphenylmethane type, trisphenol PA type or bisphenol type. The cresol novolak type polyepoxide is especially preferable.

A cresol novolak type polyepoxide is a glycidyl ether of any phenol resin represented by the following formula (I):

(I)

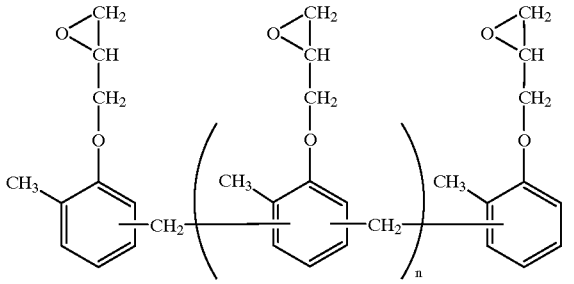

It is preferable that the epoxy equivalent of the polyepoxide is about 1500 or less. Especially preferable is about 700 or less, to provide good adhesiveness.

Furthermore, it is preferable that the zeta potential of the cresol novolak type polyepoxide water dispersion at pH 10 is negative and that the absolute value of the zeta potential is about 100 mV or more. Furthermore, it is desirable that the absolute value of the zeta potential is about 200 mV or more. In general, a polyepoxide having a smaller epoxy equivalent has a larger number of epoxy groups per total weight, and hence, stronger adhesiveness to the filament yarn is likely to be obtained.

However, the deposition state on the surface of the polyester filament yarn also greatly affects adhesiveness. Though the reason for this phenomenon is not so clear as to offer an exhaustive rationale, it has been found after repeated experiments that a cresol novolak type polyepoxide water dispersion having a negative absolute value zeta potential of about 100 mV or more at pH 10 provides remarkably strong adhesiveness even if the amount of the polyepoxide deposited is small. This is a surprising discovery.

If the polyester filament yarn single-twisted at about 3–150 turns per meter is treated by the aromatic polyepoxide water dispersion, a filament cord can be easily obtained that is excellent in all properties including adhesiveness to rubber, flexibility and smoothness as desired in the present invention.

Further, in regard to the reason why the above phenomenon occurs when an aromatic polyepoxide is applied as an initial treating agent, it may be remarked that since the aromatic polyepoxide is close to a polyester or polyphenylene sulfide in its solubility parameter, though poorer in reactivity with the filament yarn, than a polyglycidyl ether type polyepoxide, it may be likely to diffuse into the filament bundle, and into the amorphous part of the polyester filament yarn, to provide a better level of mechanical adhesiveness. This effect can be achieved only with a filament cord that has been single-twisted at about 3–150 turns per meter. If the number of turns is substantially outside that range, or if primarily twisted plural filament yarns are paralleled and twisted in the reverse direction to that of the primary twist, as adopted for a tire cord, its effectiveness becomes extremely low.

The epoxide treating agent can also contain an amine or alkali metal compound, etc. for promoting the ring opening reaction of the polyepoxide water dispersion. A rubber latex water dispersion can also be added. When a rubber latex water dispersion is added, it is preferable that a vinylpyridine-styrene-butadiene terpolymer latex is present in an amount of about 50 wt % or more in the rubber latex, and that the latex content is about 20 to 50 wt % based on the weight of the solid content of the polyepoxide water dispersion. Furthermore, to secure the dispersion stability of the treating agent, an anionic surfactant can also be added.

The (A)–(B) treating agent must contain a mixture of an initial condensation product of resorcin-formaldehyde (A) and a rubber latex (B). Only if the treatment by the (A)–(B) treating agent is effected in succession to the treatment by the aromatic polyepoxide treating agent is the remarkable adhesiveness of this invention obtained.

It is desirable that the initial condensation product of resorcin-formaldehyde (A) has a molar ratio of about 1/1.0~1/3.0 resorcin/formaldehyde. If the amount of formaldehyde is smaller than the lower limit of the range, sticky deposit waste is likely to be formed in the hose production process, and furthermore the smoothness of the filament cord is lost, and the process is likely to make the filament cord have a high frictional force. If the amount of formaldehyde is above that range, on the contrary, too much of a three-dimensional reaction takes place and the filament cord is likely to be too hard. A more suitable molar ratio of resorcin to formaldehyde in the initial condensation product of resorcin-formaldehyde (A) is about 1/1.2~1/2.0. If the molar ratio is in this range, the balance between adhesiveness to rubber and stability in the hose production process becomes most preferable.

The resorcin-formaldehyde condensation product (A) can be of the resol type obtained by reaction using an alkali metal hydroxide such as sodium hydroxide or potassium hydroxide as a catalyst, or of the novolak type obtained by reaction using an acid catalyst such as oxalic acid or hydrochloric acid. In the present invention, either can be used.

If especially high adhesiveness is required, it is preferable to use a novolak type resorcin-formaldehyde condensation product.

A suitable range of the ratio by solid content weight of the resorcin-formaldehyde condensation product (A) and the rubber latex (B) is about A/B=34/66~12/88. If the amount of the initial condensation product of resorcin-formaldehyde (A) is too large, the filament cord becomes too hard, lowering the adhesiveness to rubber. On the contrary, if the amount of the rubber latex (B) is too large, good adhesiveness cannot be obtained either. A more suitable range is about A/B=20/80~15/85.

If the second treating agent contains a parachlorophenol-resorcin-formaldehyde co-condensation product (C), even stronger adhesiveness to rubber and smoothness can be obtained. The term "parachloraphenol-resorcin-formaldehyde co-condensation product (C)" refers to a compound containing the following general formula (II) as a main component:

(II)

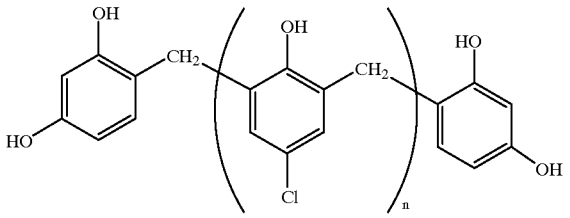

where n is an integer of 0 to 10.

The compounds represented by this general formula include 2, 6-bis(2',4'-dihydroxy-phenylmethyl)-4-chlorophenol (trade names: "VALCABOND E" (registered trademark), "CASABOND" (registered trademark) and "DENABOND E" (registered trademark)). Among them, a parachlorophenol-resorcin-formaldehyde co-condensation product (C) having a small free parachlorophenol content, such as "DENABOND E," is preferable.

In this case, it is preferable that the ratio by solid content weight of the initial condensation product of resorcin-formaldehyde (A) and the rubber latex (B) contained in the second treating agent is about A/B=34/66~12/88, and that the ratio by solid content weight of the initial condensation product of resorcin-formaldehyde (A) the parachlorophenol-resorcin-formaldehyde co-condensation product (C) and the rubber latex (B) is about (A+C)/B=60/40~30/70.

If the ratio by solid content weight of the initial condensation product of resorcin-formaldehyde (A) and the rubber latex (B) contained in the second treating agent is kept in the above range, the filament cord obtained has satisfactory adhesiveness to halogenated butyl rubber such as chlorinated butyl rubber and EPDM rubber, has flexibility and smoothness of the filament cord and does not deposit excessive waste from the treating agents in the hose production process. More preferable ranges are about A/B=25/75~20/80 and about (A+C)/B=55/45~35/65.

Furthermore, it is preferable that the rubber latex (B) of the second treating agent is a latex mixture consisting of vinylpyridine-styrene-butadiene terpolymer latex and styrene-butadiene copolymer latex and/or polybutadiene latex.

Especially when the adhesiveness to a halogenated butyl rubber such as chlorinated butyl rubber is important, it is preferable that the 2-vinylpyridine monomer content is about 5 to 15 wt % while the styrene monomer content is about 30 to 60 wt % within the total weight of all the rubber latexes.

It is more preferable that a conjugated diene monomer is present in an amount of about 30 to 60 wt % within the total weight of all the rubber latexes. It is most preferable that the 2-pyridine monomer content is about 8 to 12 wt % while the styrene monomer content is about 35 to 50 wt % within the total weight of all the rubber latexes. The term "total weight of all the rubber latexes" refers to the total of the weights of the 2-vinylpyridine monomer, styrene monomer and conjugated diene monomer contained in the respective latexes of vinylpyridine-styrene-butadiene terpolymer latex, styrene-butadiene copolymer latex and polybutadiene latex. Concretely, the above three marketed rubber latexes can be blended, to keep the 2-vinylpyridine monomer and the styrene monomer in said desired ranges within the total weight of all the rubber latexes.

On the other hand, when high adhesiveness to an EPDM rubber is desired, it is preferable that the 2-vinylpyridine monomer content is about 5 to 15 wt % while the styrene monomer content is about 5 to 25 wt % within the total weight of all the rubber latexes.

In addition, it is preferable that the conjugated diene monomer content is about 50 to 80 wt % within the total weight of all the rubber latexes. It is most preferable that the 2-pyridine monomer content is about 8 to 12 wt % while the styrene monomer content is about 5 to 25 wt %. If the styrene monomer content is more than about 25 wt %, the conjugated diene monomer content becomes relatively smaller, and the adhesiveness to EPDM rubber tends to decline. If the styrene monomer content is smaller than about 5 wt %, the smoothness of the filament cord is lost, increasing the frictional force.

The treating agent comprising resorcin-formaldehyde (A) and rubber latex (B) can also contain a slip agent such as a polyorganosiloxane compound, polyethylene oxide wax or polypropylene oxide wax; suitable slip agents are mentioned in the art, including Japanese Patent Laid-Open (Kokai) No. 61-19878, etc. Among the slip agents, a polyorganosiloxane compound is excellent, and it is preferable that the polysiloxane compound has a molecular weight of about 1000 to 2000. If the treating agent contains a polyorganosiloxane compound, the frictional resistance between the filament cord and the various guides in the hose production process can be lowered, and the accumulation of deposited waste from the treating agents at filament cord guides can be inhibited. Thus, plural filament cords can be paralleled well when the hose is produced, and the accumulation of deposit water from the treating agents in the hose production process can be inhibited. Especially dimethylsiloxane is preferable as the polysiloxane compound.

If dimethylsiloxane is used, the adhesiveness to rubber is not impaired, and both high adhesiveness to rubber and the stability in the hose production process can be achieved. If the second treating agent contains all of an initial condensation product of resorcin-formaldehyde (A), rubber latex (B), parachlorophenol-resorcin-formaldehyde co-condensation product (C) and polysiloxane compound with a molecular weight of about 1000 to 2000 (D), the present invention can provide the greatest effects. It is preferable that the amount of polysiloxane compound added is about 0.5 to 10 wt % based on the total weight of the solid content of the second treating agent. The most preferable range is about 2 to 5 wt %.

The (A+B) treating agent can also contain a blocked isocyanate. A blocked polyisocyanate compound is a compound that produces an active isocyanate compound when heated and so functions because the blocking agent is liberated. It can be a reaction product between a polyisocyanate compound such as tolylene diisocyanate, metaphenylene diisocyanate, diphenylmethane diisocyanate, hexamethylene diisocyanate or triphenylmethane triisocyanate and a blocking agent, for example, a phenol such as phenol, cresol or resorcin, a lactam such as ϵ-caprolactam or valerolactam, oxime such as acetoxime, methyl ethyl ketone oxime or cyclohexane oxime or ethyleneimine. Above all, it is preferable to use an aromatic polyisocyanate compound blocked by ϵ-caprolactam, or an aromatic compound of diphenylmethane diisocyanate. When a blocked isocyanate is added, it can be added to achieve a solid content of about 3 to 10 wt % based on the total solid content weight of the initial condensation product of resorcin-formaldehyde (A) and the rubber latex (B).

The method for depositing the treating agents on the filament yarn can include contact with a roller, or spraying from a nozzle, or immersion into a treating agent, etc. As for the solid contents of the treating agents deposited, the first (polyepoxide) treating agent can be deposited preferably in an amount of about 0.05 to 1.0 wt %, more preferably about 0.05 to 0.4 wt %, and the second treating agent (A+B) can be deposited preferably in an amount of 0.2 to 4 wt %, preferably about 0.3 to 2.0 wt %.

In the present invention, it is preferable that the polyester filament yarn treated by the polyepoxide treating agent is heat-treated at about 80 to 240° C., more preferably about 110 to 220° C. for 0.5 to 3 minutes, and that the filament yarn treated by the (A+B) treating agent is heat-treated at about 200 to 260° C., more preferably about 220 to 240° C. for about 0.5 to 3 minutes. As the most preferable heat treatment conditions, the polyester filament yarn treated by the polyepoxide treating agent is heat-treated at about 110 to 220° C. for about 0.5 to 3 minutes, and the filament yarn treated by the (A+B) treating agent is heat-treated at about 80 to 150° C. for about 0.5 to 5 minutes, and further at about 220 to 240° C. for about 0.5 to 3 minutes.

Furthermore, if the heat-treated filament yarn is mechanically softened, to break the treating agent film on the surface of the filament yarn, the formed hose can be finished soft. It is desirable that the mechanical softening is effected at a tension of about 0.1 to 0.5 g/d per filament yarn. If the mechanically softened filament yarn is heat-treated at a low temperature of about 60 to 120° C., at a tension of about 0.05 to 0.15 g/d for about 30 to 180 seconds, it can be made softer.

The filament cord so obtained has high quality processing properties in the processes of adhesive treatment and rubber product production, excellent flexibility and adhesiveness, and can be suitably used for reinforcing a brake hose or a hose for carrying refrigerant gas for an air conditioner, for example.

The hose itself is reinforced by filament cords obtained by the method. It comprises at least a halogenated butyl rubber and/or an EPDM rubber as the rubber that is in contact with the hose reinforcing fiber cords.

When the rubber of the hose is a halogenated butyl rubber, it is preferably reinforced by cords in which the 2-vinylpyridine monomer content is about 5 to 15 wt % while the styrene monomer content is about 30 to 60 wt % of the total weight of all the rubber latexes, since the adhesive strength can be improved to achieve one of the objects of the present invention.

On the other hand, if the rubber of the hose is an EPDM rubber, it is preferable that the hose is reinforced by using cords in which 2-vinylpyridine monomer is about 5 to 15 wt % while the styrene monomer content is about 5 to 25 wt % of the total weight of all the rubber latexes, since the adhesive strength can be most greatly improved to achieve one of the objects of the present invention.

EXAMPLES

The present invention is described below more concretely in reference to examples. In the following examples, the respective values were measured according to the following methods.

(1) Intrinsic Viscosity (IV)

Eight grams of a sample was dissolved into 100 ml of orthochlorophenol, and the solution was filtered to remove the adhesive. The relative viscosity ηr of the filtrate was measured using an Ostwald viscometer at 25° C., and the intrinsic viscosity IV was calculated from the following approximate expression:

$$IV=0.0242\eta r+0.2634$$

(2) Amount of End Carboxyl Groups

Zero point five gram of a sample was dissolved into 10 ml of orthochlorophenol, and the solution was filtered to remove the adhesive. The filtrate was cooled, and 3 ml of chloroform was added. Potentiometry was effected using an NaOH methanol solution, to obtain the amount.

(3) Amounts of Deposited Treating Agents

These were measured according to the dissolving method test of JIS L 1017-1995.

(4) Zeta Potential

An electrophoretic light scattering spectrophotometer Photal ELS-800 produced by Otsuka Electronics Co., Ltd. was used.

The sample was diluted with ion exchange water to a concentration of 0.05 wt %, and potassium hydroxide was added, to adjust the pH to 10, before measurement.

(5) Adhesiveness to Chlorinated Butyl Rubber and EPDM Rubber

The cord stripping test described herein was effected.

A filament cord was wound around an aluminum sheet without any clearance between them, and a chlorinated butyl rubber or EPDM rubber composed as shown in Table 1 or 2 was stuck to both sides of the aluminum sheet, and the product press-mold-vulcanized at 165° C. for 50 minutes. In this case, the rubber thickness was 3 mm, and the press pressure was adjusted to achieve a planar pressure of 30 kgf/cm$^2$ between the rubber and the filament card. The size of the aluminum sheet and the area covered by the wound filament cord can be selected as desired, and it is only required that the tension at the time of winding is such that the filament cord is not loosened when wound. The laminate was allowed to cool, and the filament cord was stripped from the rubber with the angle between the rubber and the filament cord kept at 90°. Stripping occurred at a speed of 50 mm/min at 20° C. The stripping strength in this case was expressed as N/inch.

For the rubber covering rate (%), the filament cord after being stripped from the rubber in the above cord stripping test was observed with the eyes, and the area of the filament cord surface portion still having the rubber remaining was expressed as a percentage.

For the rubber covering amount (wt %), the total amount of the covering rubber and treating agents deposited on the filament cord stripped from the rubber in the above cord stripping test was obtained by the dip pickup of the polyester according to the dissolving method test specified in JIS L 1017-1995, and the amount of deposited treating agents obtained from the sample before the cord stripping test was subtracted from the total amount. The rubber covering amount was obtained from the following formula:

$$(A-B)/(C-B)\times 100$$

where A designates the absolute dry weight of the adhering rubber+deposited treating agents B designates the absolute dry weight of the deposited treating agents C designates the absolute dry weight of the filament cord.

(6) Bending Stiffness of Filament Cord

The Gurley stiffness was used as an indicator.

A sample was allowed to stand in a heated and/or cooled room at 20° C. and 65% RH for 24 hours or more, and the filament cord was cut at a length of 1.5 inches. The bending stiffness of one filament cord was measured according to the Gurley stiffness test method of JIS L 1096-1995, with the cord gauge as the width.

(7) Bending Stiffness of Dry-heat-Treated Filament Cord

Is The Gurley stiffness was used as an indicator.

A sample loaded with 0.1 g/denier was heat-treated at 150° C. for 2 hours in a dry heat electric furnace, and the bending stiffness was measured as described above.

(8) Smoothness of Filament Cord (coefficient of dynamic friction)

The coefficient of dynamic friction between a filament cord and a satin finished chromium plated pipe was adopted as the coefficient of dynamic friction between the filament cord and a metal. The coefficient of dynamic friction and the variation thereof were obtained according to the methods described before. The friction tester shown in FIG. 1 produced by Toray Engineering was used.

If the coefficient of dynamic friction is lower, the filament cord has better smoothness. In FIG. 1 of the drawings, the symbol 1 denotes a filament cord to be measured; 2, nip rollers for yarn feed; 3, a load; 4, an inlet cord tension measuring position; 5, a satin finished chromium plate pipe; and 6, an outlet cord tension measuring roll.

(9) Deposit of Waste in Process

When the coefficient of dynamic friction between a filament cord and a satin finished chromium plated pipe was measured visually as an indicator of smoothness, the deposit waste on the guides was observed for evaluation according to the following criterion:

| | |
|---|---|
| ◎ | designates that the amount of deposit waste was very small. |
| ○ | designates the amount of deposit waste was small. |
| X | designates the amount of deposit waste was large. |
| Δ | designates the amount was between ○ and X. |

Examples 1 to 6

The treating agents used, and the results achieved, appear in Table 3 which follows. In Table 3, CN denotes an orthocresol novolak type polyepoxide; GE represents a glycidyl ether type polyepoxide; and BA represents a bisphenol A type polyepoxide.

As the epoxide treating agent, an orthocresol novolak type polyepoxide water dispersion or a bisphenol A type polyepoxide water dispersion (BA) shown in Table 3 was prepared. It had a solid content 5.0 wt %. The polyepoxide used in Example 3 was an orthocresol novolak type polyepoxide "ECN1400" produced by Asahi-Ciba Limited. In Example 5, a modified bisphenol A type epoxy emulsion "Denacole EX1101" produced by Nagase Chemicals Ltd. was used. In Example 6, a modified bisphenol A type epoxy emulsion "Denacole EX1103" produced by Nagase Chemicals Ltd. was used.

As the (A+B) treating agent, the initial condensation product (A) of resorcin-formaldehyde obtained by reacting 1 mole of resorcin and 2.00 moles of formaldehyde with each other, and a rubber latex mixture (B) consisting of vinylpyridine-styrene-butadiene terpolymer latex and polybutadiene latex were mixed at a ratio, by solid content weight, of A/B=20/80, and the mixture was ripened for 24 hours.

In this case, a novolak type pre-condensation product SUMIKANOL 700 (produced by Sumitomo Chemical) obtained by preliminarily condensing resorcin and formaldehyde at a molar ratio of resorcin/formaldehyde =1/0.65 using an acid catalyst was dissolved into water with a predetermined amount of sodium hydroxide dissolved, and formaldehyde was added. Furthermore, the 2-vinylpyridine monomer content in the rubber latex mixture was 10 wt %, and the styrene monomer content was 20 wt %. To the mixture, a compound of said general formula (II) ("CASABOND" produced by Thomas Swan Co., Ltd.) was added to achieve a ratio by solid content weight of (A+C)/B=45/55, and a water dispersion of dimethylsiloxane with a molecular weight of 1400 (D) was added to achieve a ratio by solid content weight of 4 wt % based on the weight of (A+B+C), to prepare second treating agent with a solid content of 12 wt %.

On the other hand, polyethylene terephthalate (PET) of 0.95 intrinsic viscosity measured in o-chlorophenol at 25° C., and 17 equivalents/ton of end carboxyl groups, was melt-spun and stretched, to produce a raw yarn of 1500 denier consisting of 360 filaments. It was S-twisted at 100 turns per meter, to prepare raw cord.

The raw cord was immersed in the epoxide treating agent shown in Table 3 using a Litzer Compultreater Laboratory Unit (produced by The C.A. Litzer Co., Inc.), heat-treated at 130° C. for 60 seconds, immersed in the stated (A+B) treating agent, dried at 130° C. for 90 seconds, then heat-treated at 240° C. for 60 seconds, and mechanically softened with a tension of 0.15 g/d applied to the filament yarn, to obtain a hose reinforcing filament cord. In this way, six different hose reinforcing filament cords were obtained. Their evaluation is shown in Table 3.

As can be seen from the results of Table 3, the hose reinforcing polyester filament cords treated according to the method of the present invention can greatly decrease the cord tackiness and the deposit waste production while also providing good processability, all of which were problems of the conventional methods. The new hoses also had superior adhesiveness, flexibility and smoothness than was achieved by those of the conventional methods.

Comparative Example 1

A filament cord was treated as described for Example 1, except that the treating agents stated in Example 1 of Japanese Patent Laid-Open (Kokai) No. 9-210262 were used. This was a conventional example.

The first treating agent was prepared by adding 6 parts of weight of a silicate compound with a thixotropy indicator of 8.9 to 100 parts by weight of a mixture consisting of an epoxy compound ("Denacole EX313" produced by Nagase Chemicals Ltd.)/a blocked isocyanate ("DM60" produced by Meisei Chemicals Works, Ltd.)/a vinylpyridine-styrene-butadiene terpolymer latex ("Nipol 2518GL" produced by Nippon Zeon Co., Ltd.) at a ratio of 11/23/66 wt % as solid contents.

The second treating agent was obtained by using an initial condensation product of 1/1.5 in the molar ratio of resorcin to formalin in supplied amount, a rubber latex mixture consisting of 80 parts by weight of vinylpyridine-styrene-butadiene terpolymer latex ("Nipol 2518GL" produced by Nippon Zeon Co., Ltd. and 20 parts by weight of styrene-butadiene copolymer latex ("Nipol LX 1112" produced by Nippon Zeon Co., Ltd.), and diphenylmethane-bis 4,4'-N, N'-diethyleneurea compound at a ratio by solid content weight of resorcin-formalin initial condensation product/rubber latex mixture/diethyleneurea compound=11.4/79.5/9.1. The deposited amount of the first treating agent was 1.1 wt %, and that of the second treating agent was 2.2 wt %. The peeling strength between the cord and the EPDM rubber was 60 N/inch, and the rubber covering area on the peeled surface was 10%, while the rubber covering amount was 0 wt %. The peeling strength between the cord and CI-IIR rubber was 10 N/inch, and the rubber covering area on the peeled surface was 0%, while the rubber covering amount was 0 wt %. Furthermore, as shown in FIG. 2, the coefficient of dynamic friction was 0.65 and the variation in the coefficient of dynamic friction was 0.08. The bending stiffness of the filament cord was 2,500 mg, and the bending stiffness of the heated filament cord was 4,000 mg. The deposit waste from the treating agents was "x". So, the filament cord was inferior for hose reinforcement.

Comparative Example 2

A hose reinforcing filament cord was obtained as described for Example 1, except that the glycidyl ether type polyepoxide (GE) shown in Table 3 was used as the first treating agent. The glycidyl ether type polyepoxide used was "Denacole EX313" produced by Nagase Chemicals Ltd. The evaluation results of the hose reinforcing filament cord of this Example are also shown in Table 3.

Examples 7 to 13

Hose reinforcing filament cords were obtained as described for Example 1, except that the (A+B) treating agent was obtained by mixing at a ratio shown in Table 4, though the first treating agent stated in Example 1 was used as the first treating agent. The expression "2-VP" in Table 3 denotes the 2-vinylpyridine monomer content within the total weight of the latex in the (A+B) treating agent, and the expression "St" denotes the styrene monomer content. The evaluation results of these hose reinforcing filament cords are also shown in Table 4.

As can be seen from Table 4, as for the composition of the second treating agent, when the initial condensation product of resorcin-formaldehyde (A), rubber latex (B) and parachlorophenol-resorcin-formaldehyde co-condensation product (C) were contained at the ratios by solid content weight expressed in the following equations (1) and (2), the effects became remarkable. That is, the resulting cords satisfied all requirements of adhesiveness to chlorinated butyl rubber, smoothness and waste deposit from the treating agents:

(1) A/B=34/66~12/88

(2) (A+C)/B=60/40~30/70

When the 2-vinylpyridine monomer content was 5 to 15 wt % while the styrene monomer content was 30 to 60 wt % within the total weight of all the rubber latexes, the adhesiveness to chlorinated butyl rubber became especially high, and when the 2-vinylpyridine monomer content was 5 to 15 wt % while the styrene monomer content was 5 to 30 wt % within the total weight of all the rubber latexes, the adhesiveness to EPDM rubber became high.

Examples 14 to 17

The particulars of these tests appear in Table 5.

Hose reinforcing filament cords were obtained as described for Example 1, except that the (A+B) treatment agent was obtained by mixing at the 20/80 ratio shown in Table 5, though the first treating agent stated in Example 1 was used. Especially for obtaining high adhesiveness to chlorinated butyl rubber, with the smoothness and freedom from deposit waste from the treating agents kept satisfied, it was found desirable that the optimum amount of the deposited first treating agent on the polyester was about 0.05 to 0.4 wt % and that the amount of the deposited second treating agent (A+B) was about 0.3 to 2.0 wt %.

TABLE 1

| Rubber composition | |
|---|---|
| Compound | Parts by weight |
| EPDM rubber | 100.0 |
| Zinc dust | 5.0 |
| Stearic acid | 1.0 |
| Carbon black | 60.0 |
| 2-mercaptobenzothiazole | 0.5 |
| Tetramethylthiuram disulfide | 1.0 |
| Oil | 5.0 |
| Sulfur | 1.5 |

TABLE 2

| Rubber composition | |
|---|---|
| Compound | Parts by Weight |
| Chlorinated butyl rubber | 100.0 |
| Zinc dust | 5.0 |
| Stearic acid | 1.0 |
| Carbon black | 55.0 |
| Oil | 6.5 |
| 2-mercaptobenzothiazole | 0.7 |
| Tetramethylthiuram disulfide | 1.5 |
| Sulfur | 1.5 |

TABLE 3

| | Example 1 | Example 2 | Example 3 | Example 4 | Example 5 | Example 6 | Comparative Example 2 |
|---|---|---|---|---|---|---|---|
| First treating agent | | | | | | | |
| Second treating agent | | | | | | | |
| A/B [ratio by solid content weight] | 20/80 | 20/80 | 20/80 | 20/80 | 20/80 | 20/80 | 20/80 |
| (A + C)/B [ratio by solid content weight] | 45/55 | 45/55 | 45/55 | 45/55 | 45/55 | 45/55 | 45/55 |
| 2-VP [wt %] | 10 | 10 | 10 | 10 | 10 | 10 | 10 |
| St [wt %] | 20 | 20 | 20 | 20 | 20 | 20 | 20 |
| Amount of deposited first treating agent [wt %] | 0.2 | 0.4 | 0.5 | 0.3 | 1.3 | 0.5 | 0.3 |
| Amount of deposited second treating agent [wt %] | 0.7 | 1.5 | 1.4 | 1.4 | 2.1 | 2.1 | 2.1 |
| Adhesive strength to EPDM rubber [N/inch] | 140 | 170 | 150 | 120 | 130 | 160 | 70 |
| Rubber covering area [%] | 50 | 80 | 50 | 50 | 40 | 50 | 30 |
| Rubber covering amount [wt %] | 10.1 | 15.5 | 10.0 | 8.2 | 4.3 | 9.2 | 2.0 |
| Adhesive strength to chlorinated butyl rubber [N/inch] | 80 | 70 | 55 | 40 | 40 | 45 | 20 |
| Rubber covering area [%] | 60 | 40 | 30 | 30 | 30 | 30 | 5 |
| Rubber covering amount [wt %] | 10.2 | 8.6 | 4.0 | 3.7 | 3.4 | 3.5 | 0.5 |
| Coefficient of dynamic friction | 0.27 | 0.30 | 0.31 | 0.31 | 0.35 | 0.35 | 0.46 |

TABLE 3-continued

| | Example 1 | Example 2 | Example 3 | Example 4 | Example 5 | Example 6 | Comparative Example 2 |
|---|---|---|---|---|---|---|---|
| Variation of coefficient of dynamic friction | 0.02 | 0.02 | 0.02 | 0.02 | 0.05 | 0.04 | 0.10 |
| Filament cord hardness [mg] | 400 | 800 | 500 | 600 | 2,000 | 1,700 | 700 |
| Heated filament cord hardness [mg] | 800 | 1,200 | 1,800 | 1,800 | 3,500 | 2,500 | 2,200 |
| Deposit waste from treating agents | ◎ | ○ | ○ | ○ | ○~Δ | ○~Δ | X |

CN: Orthocresol novolak type polyepoxide

GE: Glycidyl ether type polyepoxide

BA: Bisphenol A type polyepoxide

TABLE 4

| | Example 7 | Example 8 | Example 9 | Example 10 | Example 11 | Example 12 | Example 13 |
|---|---|---|---|---|---|---|---|
| First treating agent | | | | | | | |
| Epoxy species | CN | CN | CN | CN | CN | CN | CN |
| Epoxy equivalent [g/eq.] | 550 | 550 | 230 | 235 | 550 | 550 | 550 |
| Zeta potential at pH 10 [mV] | −210 | −210 | −210 | −210 | −210 | −210 | −210 |
| Second treating agent | | | | | | | |
| A/B [ratio by solid content weight] | 25/75 | 20/80 | 10/90 | 25/75 | 25/75 | 25/75 | 25/75 |
| (A + C)/B [ratio by solid content weight] | 50/50 | 52/48 | 46/54 | 65/35 | 50/50 | 50/50 | 50/50 |
| 2-VP [wt %] | 12 | 8 | 8 | 8 | 15 | 15 | 8 |
| St [wt %] | 28 | 17 | 17 | 17 | 15 | 35 | 8 |
| Amount of deposited first treating agent [wt %] | 0.2 | 0.3 | 0.3 | 0.3 | 0.2 | 0.1 | 0.3 |
| Amount of deposited second treating agent [wt %] | 1.5 | 1.6 | 1.5 | 1.4 | 1.4 | 1.7 | 1.7 |
| Adhesive strength to EPDM rubber [N/inch] | 140 | 130 | 130 | 120 | 130 | 130 | 150 |
| Rubber covering area [%] | 50 | 50 | 40 | 40 | 40 | 30 | 50 |
| Rubber covering amount [wt %] | 10.2 | 8.1 | 4.5 | 4.0 | 4.4 | 3.2 | 11.3 |
| Adhesive strength to chlorinated butyl rubber [N/inch] | 80 | 70 | 50 | 45 | 50 | 70 | 45 |
| Rubber covering area [%] | 60 | 60 | 50 | 30 | 40 | 60 | 40 |
| Rubber covering amount [wt %] | 10.6 | 12.4 | 12.5 | 6.2 | 8.0 | 12.5 | 8.0 |
| Coefficient of dynamic friction | 0.27 | 0.29 | 0.35 | 0.32 | 0.29 | 0.27 | 0.32 |
| Variation of coefficient of dynamic friction | 0.02 | 0.03 | 0.6 | 0.03 | 0.02 | 0.02 | 0.03 |
| Filament cord hardness [mg] | 600 | 400 | 400 | 1,200 | 500 | 800 | 200 |
| Heated filament cord hardness [mg] | 1,200 | 1,200 | 1,200 | 2,400 | 800 | 1,500 | 800 |
| Deposit waste from treating agents | ◎ | ○ | ○~Δ | ○~Δ | ◎ | ◎ | ○~Δ |

CN: Orthocresol novolak type polyepoxide

TABLE 5

| | Example 1 | Example 14 | Example 15 | Example 16 | Example 17 |
|---|---|---|---|---|---|
| First treating agent | | | | | |
| Epoxy species | CN | CN | CN | CN | CN |
| Epoxy equivalent | 500 | 550 | 230 | 550 | 550 |
| Zeta potential at pH 10 [mV] | −210 | −210 | −210 | −210 | −210 |
| Second treating agent | | | | | |
| A/B [ratio by solid content weight] | 20/80 | 20/80 | 20/80 | 20/80 | 20/80 |
| (A + C)/B [ratio by solid content weight] | 45/55 | 45/55 | 45/55 | 45/55 | 45/55 |
| 2-VP [wt %] | 10 | 10 | 10 | 10 | 10 |
| St [wt %] | 20 | 20 | 20 | 20 | 20 |
| Amount of deposited first treating agent [wt %] | 0.2 | 0.05 | 1.1 | 0.2 | 0.2 |
| Amount of deposited second treating agent [wt %] | 0.7 | 1.4 | 1.5 | 0.5 | 2.4 |
| Adhesive strength to EPDM rubber [N/inch] | 140 | 120 | 130 | 120 | 160 |
| Rubber covering area [%] | 50 | 40 | 50 | 40 | 60 |
| Rubber covering amount [wt %] | 10.1 | 7.2 | 8.0 | 7.5 | 12.3 |
| Adhesive strength to chlorinated butyl rubber [N/inch] | 80 | 60 | 60 | 90 | 50 |
| Rubber covering area [%] | 60 | 40 | 40 | 70 | 40 |
| Rubber covering amount [wt %] | 10.2 | 7.4 | 8.0 | 15.3 | 6.0 |
| Coefficient of dynamic friction | 0.27 | 0.27 | 0.31 | 0.27 | 0.34 |
| Variation of coefficient of dynamic friction | 0.02 | 0.01 | 0.02 | 0.02 | 0.02 |
| Filament cord hardness [mg] | 400 | 300 | 1,000 | 400 | 1,000 |
| Heated filament cord hardness [mg] | 800 | 800 | 1,800 | 600 | 2,400 |
| Deposit waste from treating agents | ◎ | ◎ | ○ | ◎ | ○~Δ |

CN: Orthocresol novolak type polyepoxide

Industrial Applicability

The present invention created a hose reinforcing polyester filament cord having high quality properties such as good processability in the hose production process, and excellent adhesiveness to a halogenated butyl rubber and/or an EPDM rubber. The hose obtained by using the filament cord was effectively used as a hose for a brake, a hose for an automotive air conditioner, and is capable of a wide variety of other uses.

What is claimed is:

1. A hose reinforcing filament cord, comprising a polyester multiple filament yarn single-twisted at about 3–150 turns per meter into a twisted cord, said cord having a coating comprising an aromatic polyepoxide and a condensation product of resorcin-formaldehyde (A) and a rubber latex (B) deposited thereon, said cord satisfying all of the following properties (a) to (c):

(a) a coefficient of dynamic friction as measured between said cord and a smooth metal surface, of about 0.15 to 0.35, (b) a variation of coefficient of dynamic friction, between said filament cord and said smooth metal surface, of about 0.05 or less, and (c) a rubber covering amount remaining on said cord after a standard cord stripping test of about 3 wt % or more when said standard cord stripping test comprises the steps of winding a filament cord around an aluminum sheet, sticking a chlorinated butyl rubber or EPDM rubber to both sides of said aluminum sheet, press mold-vulcanizing said aluminum sheet, cooling said aluminum sheet, stripping said filament cord from said rubber with an angle of 90° between said filament cord and said rubber, and determining said rubber covering amount using the following formula:

$$(A-B)/(C-B)\times 100$$

wherein A designates the absolute dry weight of the adhering rubber and the deposited treating agents, B designates the absolute dry weight of the deposited treating agents, and C designates the absolute dry weight of the filament cord.

2. A hose reinforcing filament cord according to claim 1, wherein said polyester filament yarn comprises ethylene terephthalate as a main component, and has an intrinsic viscosity of about 0.80 or more and has end carboxyl groups in an amount of about 20 equivalents/ton or less.

3. A hose reinforcing filament cord according to claim 1, having a bending stiffness of about 1000 mg or less, and having a bending stiffness after dry heat treatment at 150° C. of about 2000 mg or less.

* * * * *

UNITED STATES PATENT AND TRADEMARK OFFICE

CERTIFICATE OF CORRECTION

PATENT NO. : 6,358,610 B1
DATED : March 19, 2002
INVENTOR(S) : Taniguchi et al.

It is certified that error appears in the above-identified patent and that said Letters Patent is hereby corrected as shown below:

Column 6,
Line 45, please change “yam” to -- yarn --.

Signed and Sealed this

First Day of October, 2002

*Attest:*

*Attesting Officer*

JAMES E. ROGAN
*Director of the United States Patent and Trademark Office*